US008915475B2

(12) United States Patent
Bryan

(10) Patent No.: US 8,915,475 B2
(45) Date of Patent: Dec. 23, 2014

(54) ADJUSTABLE MAILBOX POST

(71) Applicant: Jeffrey Bryan, Califon, NJ (US)

(72) Inventor: Jeffrey Bryan, Califon, NJ (US)

( * ) Notice: Subject to any disclaimer, the term of this patent is extended or adjusted under 35 U.S.C. 154(b) by 0 days.

(21) Appl. No.: 13/832,527

(22) Filed: Mar. 15, 2013

(65) Prior Publication Data

US 2014/0263881 A1 Sep. 18, 2014

(51) Int. Cl.
*A47G 29/12* (2006.01)
*A47G 29/122* (2006.01)

(52) U.S. Cl.
CPC ..... *A47G 29/1216* (2013.01)
USPC ..... 248/145; 248/219.3; 232/39

(58) Field of Classification Search
CPC ... A47G 29/00; A47G 29/12; A47G 29/1216; F16M 11/046; F16M 11/048; F16M 2200/066
USPC ..... 248/145, 146, 156, 157, 218.4, 219.2, 248/219.3, 519–527, 123.2, 297.21; 40/607.01, 607.1, 606.01, 606.14, 40/606.16, 607.09; 232/1 C, 1 R, 39; 211/204, 206
See application file for complete search history.

(56) References Cited

U.S. PATENT DOCUMENTS

| | | | | | |
|---|---|---|---|---|---|
| 730,806 | A | * | 6/1903 | Sword | 232/39 |
| 3,392,945 | A | * | 7/1968 | Graham | 248/124.2 |
| 3,593,914 | A | | 7/1971 | Van Orden | |
| 3,749,342 | A | * | 7/1973 | Perrine | 248/123.2 |
| 3,802,656 | A | | 4/1974 | Virblas | |
| 4,172,579 | A | * | 10/1979 | Steinman | 248/145 |
| 4,484,705 | A | * | 11/1984 | Sande | 232/39 |
| 5,042,716 | A | | 8/1991 | Robbins | |
| 5,164,011 | A | * | 11/1992 | Ray | 118/500 |
| 5,215,283 | A | | 6/1993 | Gould | |
| 5,524,853 | A | | 6/1996 | Varlaro | |

* cited by examiner

*Primary Examiner* — Tan Le
(74) *Attorney, Agent, or Firm* — Thomas J. Germinario

(57) ABSTRACT

An adjustable mailbox post comprises a vertical support member rotatably attached to a cross-member. The cross-member extends through a transverse channel in the support member, such that a forward arm of the cross-member extends from the forward side of the support member, and a rear arm of the cross-member extends from the rear side of the support member. The forward arm supports a mailbox platform, to which a mailbox can be attached. Using a spring mechanism and/or an extendable strut, the forward arm of the post can be lifted from a horizontal position appropriate for mail delivery to an elevated position, in which the mailbox is out of the reach of passing snow-plows. Latching mechanisms are used to secure the forward arm of the post in either the horizontal delivery position or the elevated safety position.

1 Claim, 10 Drawing Sheets

ADJUSTABLE MAILBOX POST

BACKGROUND OF THE INVENTION

The present invention relates to the field of structures used to support mailboxes, and more particularly to cross-member type mailbox posts.

Mailbox posts of the type having a vertical support member and a horizontal cross-member are in widespread use in rural and semi-rural areas. Thus mailbox posts are typically located immediately adjacent to a road or street, so that the mail delivery person in a vehicle can open the mailbox and collect and/or insert mail without getting out of the delivery vehicle. In order to facilitate this mail delivery procedure, U.S. Postal Service guidelines require that the mailbox be positioned at a height of 41 to 45 inches above the road/street surface.

Because of the proximity of the mailbox and post to the road, they are often damaged or detached by snowplowing—either by direct impact or by the pressure of snow pushed against them. During snow storms, therefore, it is useful to be able to adjust the mailbox post so that the mailbox is more out of the way of plows and roadside snow piles. The patent literature describes several types of post structure that can rotate horizontal or vertically to displace the mailbox from the path of snowplows. These designs have the disadvantage, however, of making the mailbox, after such displacement, inaccessible from the postal delivery vehicle.

The adjustable mailbox post of the present invention, on the other hand, allows the mailbox to be raised and lowered by a person seated in a motor vehicle at the roadside without getting out of the vehicle. During a snowstorm, the owner of the mailbox seated in his/her vehicle can raise its height out of the way of snowplows. After the snowplows have passed, the mail delivery person can lower the mailbox back to the proper height without leaving their vehicle.

SUMMARY OF THE INVENTION

The mailbox post of the present invention comprises a vertical support member rotatably attached at a transverse axis to a cross-member by one or more axial pins or rods. The cross-member extends through a transverse channel in the support member, such that a forward arm of the cross-member extends from the forward side of the support member, and a rear arm of the cross-member extends from the rear side of the support member. The forward arm supports a mailbox platform, to which a mailbox can be attached. The support member comprises a branched upper post, through which the transverse channel passes, and a lower post below the transverse channel.

A spring mechanism, which can be either a coil spring or a pneumatic spring, extends diagonally between the cross-member and the support member. The spring mechanism is configured so as to generate a lifting torque about the transverse axis, which torque tends to lift the forward arm of the cross member when the cross member is horizontally aligned.

Referring to FIGS. 7A-7D, the spring mechanism can be in one of four positions: (A) between the rear arm and the upper post, as shown in FIG. 7A, (B) between the forward arm and the lower post, as shown in FIG. 7B, (C) between the rear arm and the lower post, as shown in FIG. 7C, or (D) between the forward arm and the upper post, as shown in FIG. 7D. With the forward arm horizontally positioned to the left, as depicted in FIGS. 7A-7D, the spring mechanism must generate a clockwise torque about the transverse axis. In order to generate a clockwise torque about the transverse axis, the spring mechanism must be under compression in positions A and B (FIGS. 7A and 7B) and under tension in positions C and D (FIGS. 7C and 7D).

A releasable latch mechanism connects the cross-member and the support member so as to maintain the cross-member in a horizontal position, in which the mailbox platform is at the height prescribed by applicable postal regulations. The latch mechanism can be in the form of a striker and cooperating striker plate, or it can be an adjustable-length strut.

When the latch mechanism is released, the lifting torque generated by the spring mechanism causes the forward arm of the cross-member to rotate upward and backward toward the upper post so that the cross-member assumes an elevated position, in which the raised mailbox platform is safely removed from a zone of potential impacts.

Optionally, a releasable second latch mechanism can be used to secure the cross-member in the elevated position. Alternately, the adjustable-length strut can have one or more spring-button locking pins to maintain its length corresponding to either the horizontal position or the elevated position of the cross-member. In yet another alternative, the tubular strut can be used alone, without the spring mechanism, to secure the cross-member in either the horizontal or elevated position. For the latter alternative, the tubular strut can be in any one of the four positions depicted in FIGS. 7A-7D.

Optionally, suspended from the lower surface of the mailbox platform is a pull-down cord, by which the forward arm of the cross-member can be pulled down and forward from the elevated position into the horizontal position.

The foregoing summarizes the general design features of the present invention. In the following sections, specific embodiment of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1:
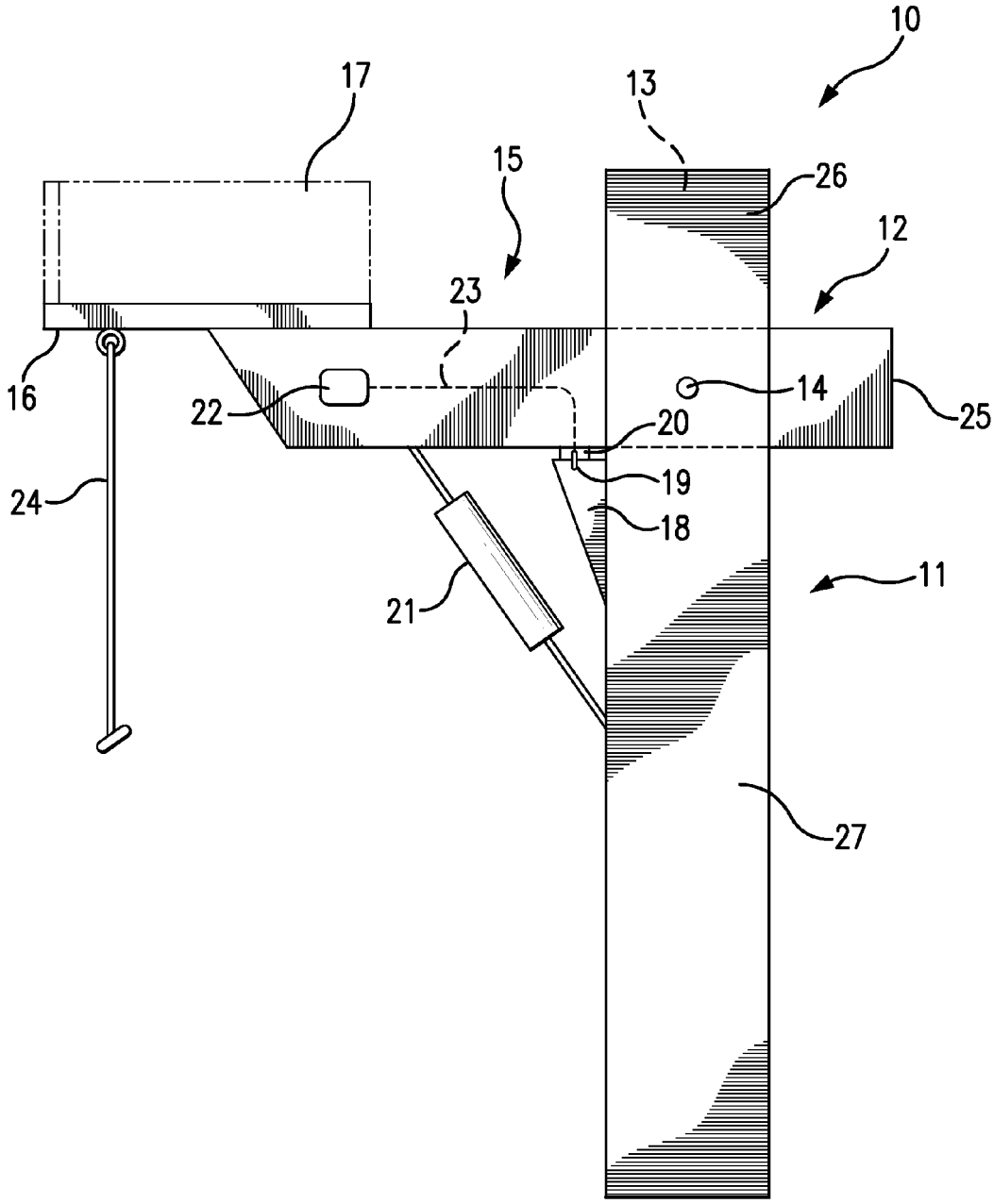
FIG. 1 is a side profile view of the first preferred embodiment of the present invention showing the cross-member in the horizontal position.
Figure 2:
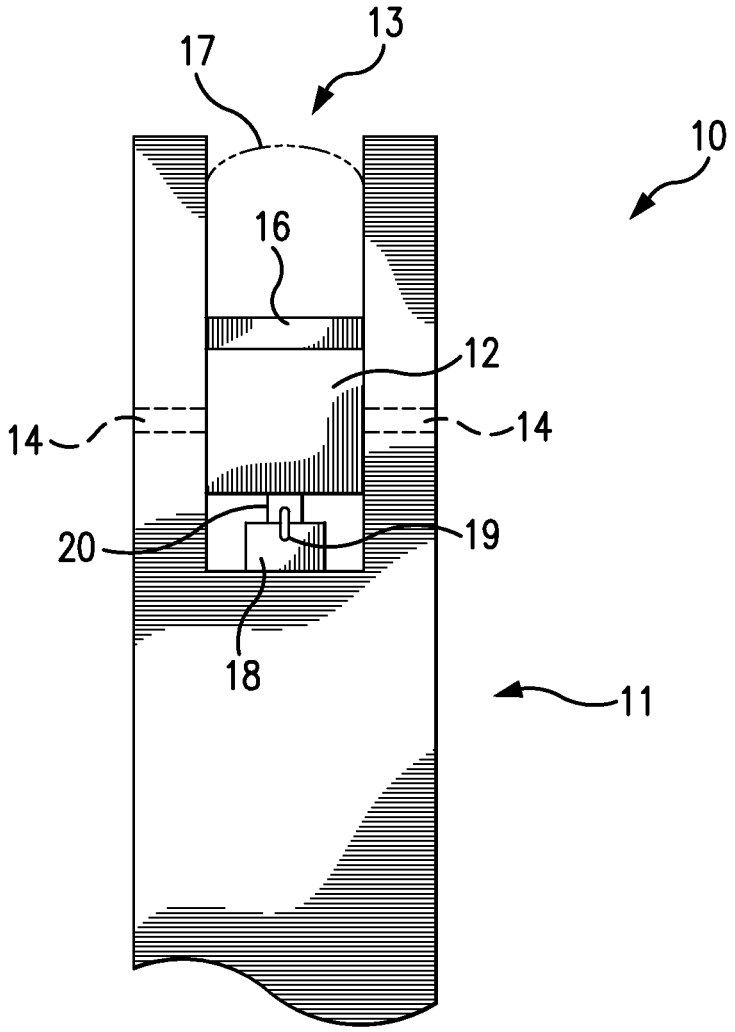
FIG. 2 is a partial rear profile view of the first preferred embodiment of the present invention showing the cross-member in the horizontal position.
Figure 3:
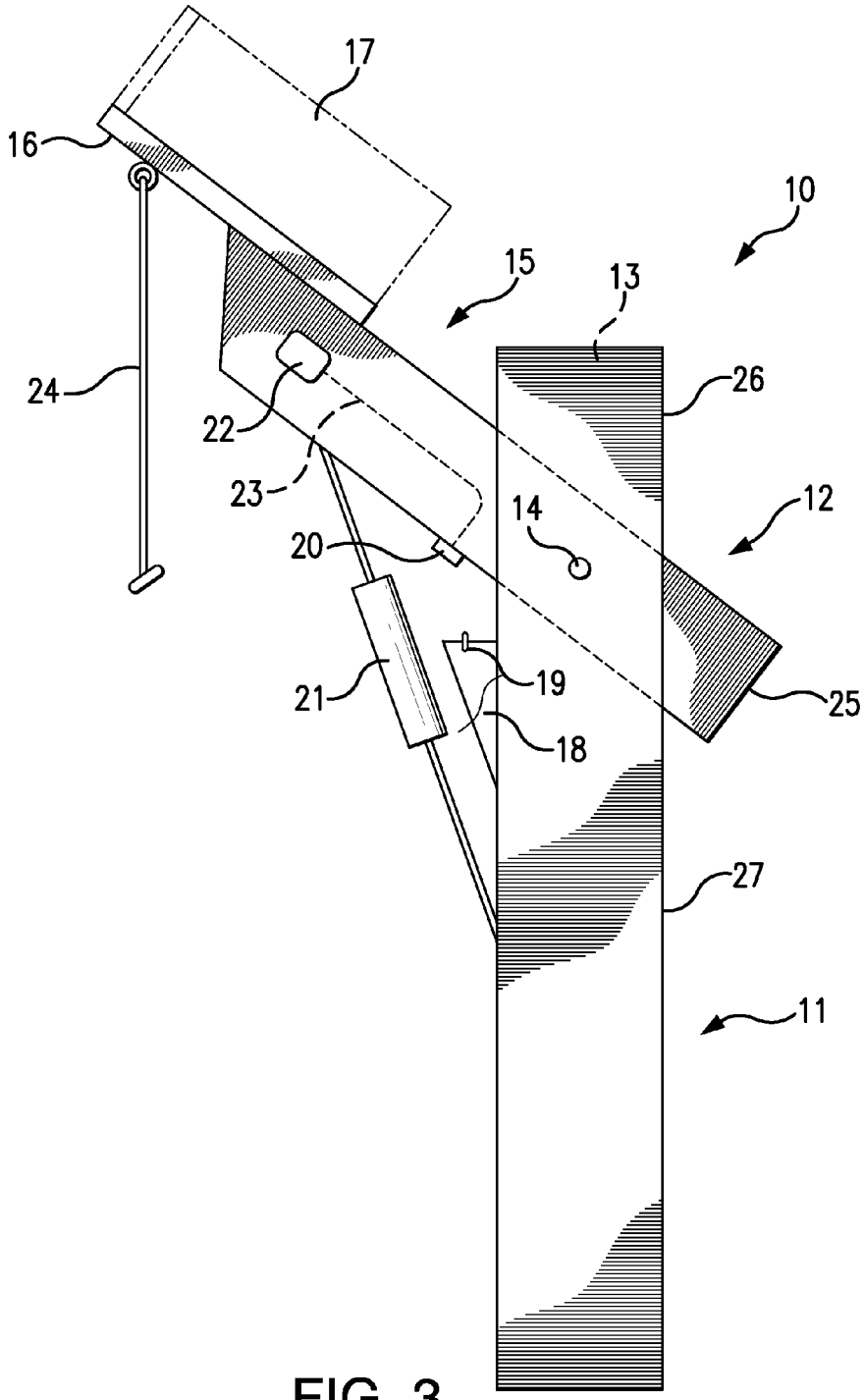
FIG. 3 is a side profile view of the first preferred embodiment of the present invention showing the cross-member in the elevated position.

Referring to FIG. 1, the first preferred embodiment of the present invention 10 has a vertical support member 11, to which a cross-member 12 is rotatably attached. As seen in FIG. 2, the cross-member 12 passes through a transverse first channel 13 in the upper post 26 of the support member 11, where it is rotationally supported by an axial pin 14.

The forward arm 15 of the cross-member 12 supports a mailbox platform 16, which in turn can support a mailbox 17. From the front face of the support member 11 extends a striker plate 18, from the upper surface of which extends a striker 19. The striker 19 has an arched tubular structure which slidably cooperates with a latch mechanism 20 on the underside of the forward arm 15 of the cross-member 12. The striker 19 and latch mechanism 20 are preferably of the kind commonly used to secure trunks lids and hatchbacks of motor vehicles, such as is described in U.S. Pat. No. 6,059,237, which is incorporated herein by reference. When the cross-member 12 is in a horizontal position, as depicted in FIG. 1, the striker 19 engages the latch mechanism 20 and secures the cross-member in the horizontal position, with the mailbox platform 16 at the height prescribed by postal regulations.

Between the underside of the forward arm 15 of the cross-member 12 and the front face of the support member 11 there obliquely extends a spring mechanism 21, which is compressed when the cross-member 12 is in the horizontal position, as shown in FIG. 1. The spring mechanism 21 is preferably a pneumatic spring, with a dampening control orifice by-pass to slow its opening speed, of the type described in U.S. Pat. No. 4,570,912, which is incorporated herein by reference. The dampened expansion of the pneumatic spring 21 reduces stress and wear on the components of the present invention.

The latch mechanism 20 is disengaged from the striker 19 by the leveraging action of a latch release retracting a release wire 23 connected to the latch mechanism 20. This disengagement of the latch mechanism 20 allows the spring mechanism 21 to expand, thereby forcing the forward arm 15 of the cross-member 12 to rotate upward and backward into an elevated position, as depicted in FIG. 2. The forward arm 15 of the cross-member 12 can be pulled back down into the horizontal position by a cord 24 suspended from the lower surface of the mailbox platform 16.

Figure 4:
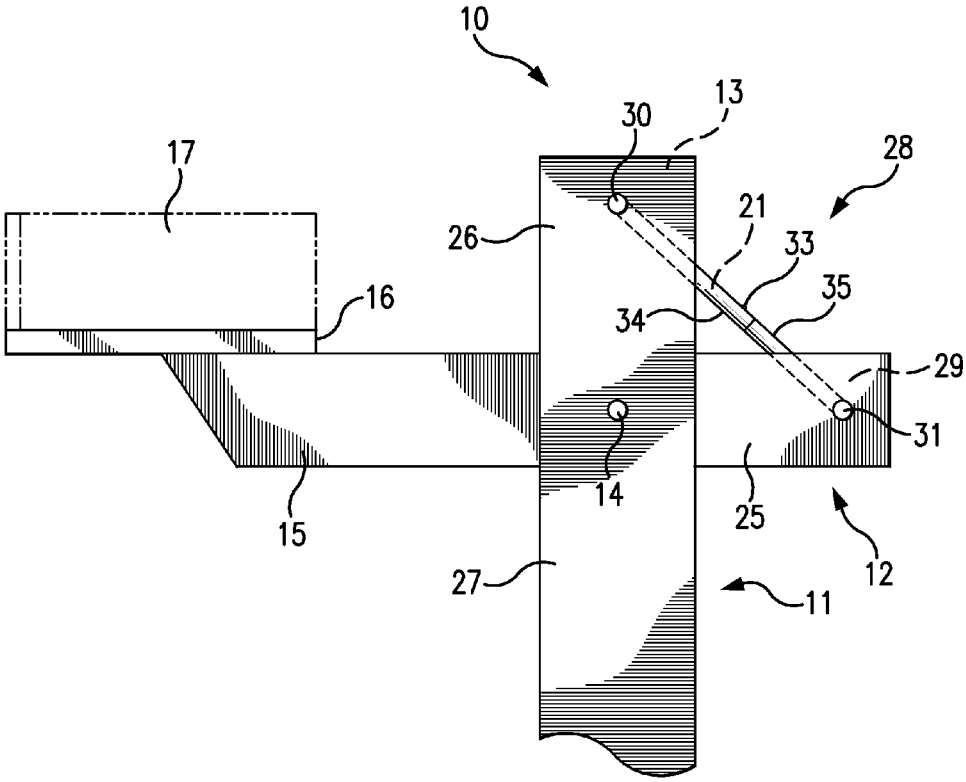
FIG. 4 is a side profile view of the second preferred embodiment of the present invention showing the cross-member in the horizontal position.
Figure 5:
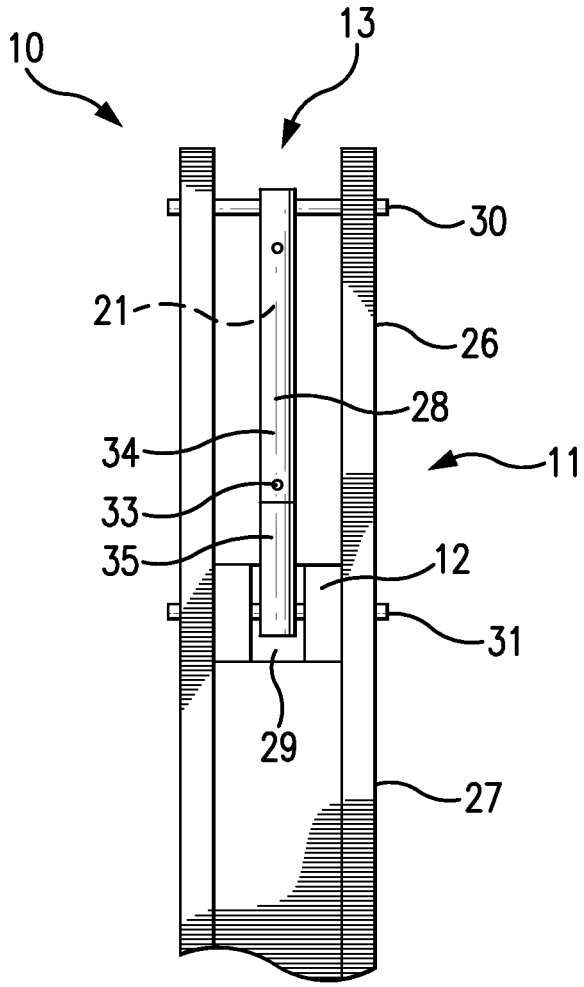
FIG. 5 is a partial rear profile view of the second preferred embodiment of the present invention showing the cross-member in the horizontal position.
Figure 6:
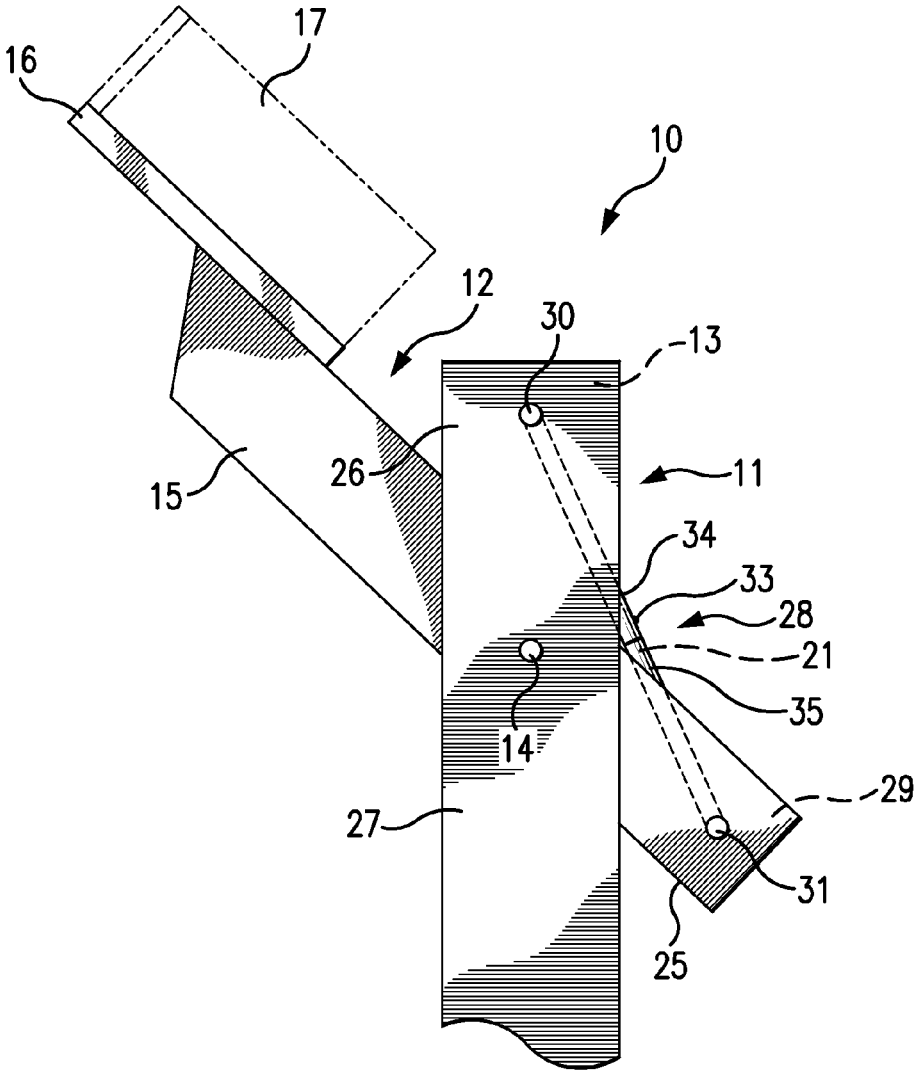
FIG. 6 is a side profile view of the second preferred embodiment of the present invention showing the cross-member in the elevated position.
Figure 7A:
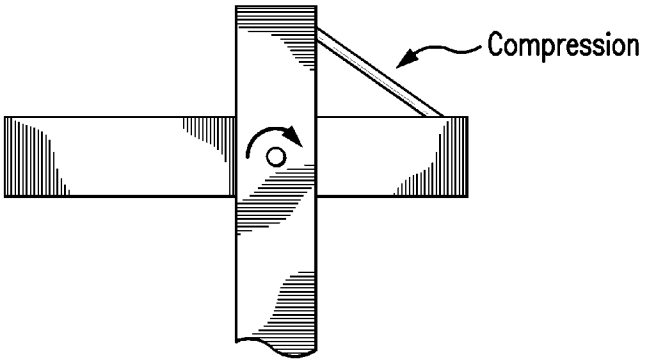
FIGS. 7A-7D are side profile views of the present invention showing four alternate configurations of the spring mechanism or tubular strut.
Figure 7B:
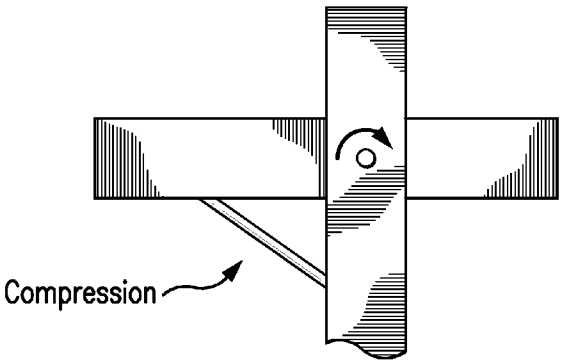
Figure 7C:
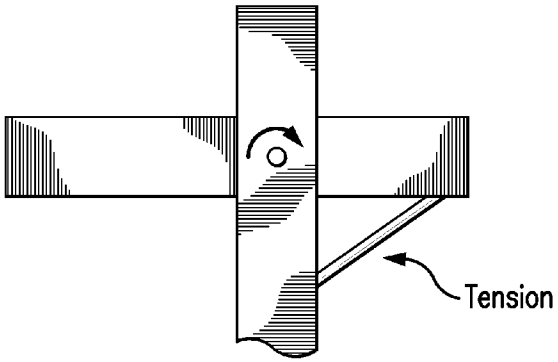
Figure 7D:
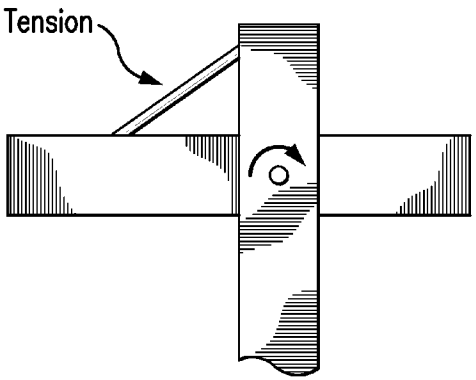

Referring to FIGS. 4-6, the second preferred embodiment of the present invention 10 has a vertical support member 11, to which a cross-member 12 is rotatably attached by an axial pin 14. The cross-member 12 extends through a transverse first channel 13 in the upper post 26 of the support member 11, such that its forward arm 15 extends from one side of the support member 11, and its rear arm 25 extends from the other side. The forward arm 15 of the cross-member supports a mailbox platform 16, which can support a mailbox 17. The support member 11 comprises a branched upper post 26, through which the first channel 13 passes, and a lower post 27 below the first channel 13.

Referring to FIGS. 4 and 5, an adjustable-length telescoping tubular strut 28, having an interior spring mechanism 21, extends diagonally between the rear arm 25 of the cross-member 11 and the upper post 26 of the support member. The rear arm 25 has a transverse second channel 29, through which passes a lower strut pin 31, to which the proximal end of the tubular strut 28 is rotatably attached. The distal end of the tubular strut 28 is rotatably attached to an upper strut pin 30, which extends through the upper end of the first channel 13.

Figure 8A:
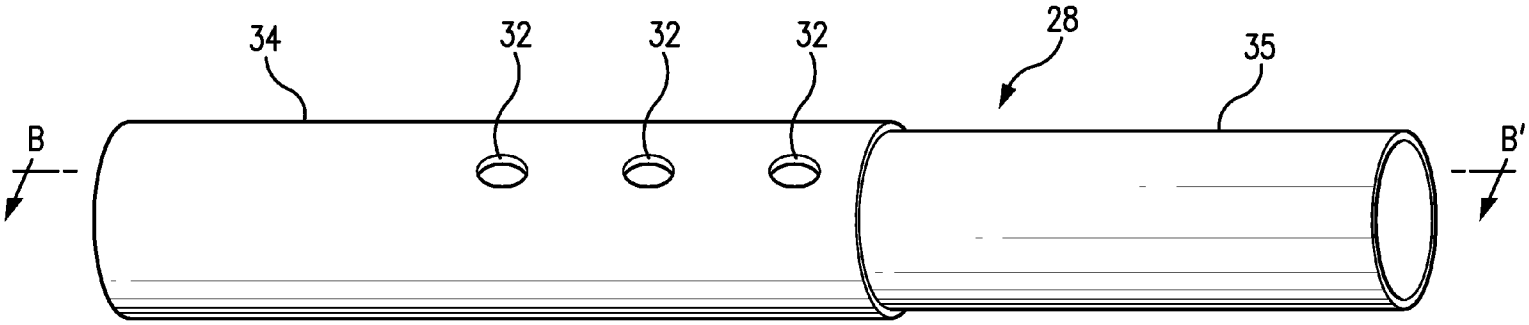
FIG. 8A is a detail perspective view of a telescoping tubular adjustable-length strut.
Figure 8B:
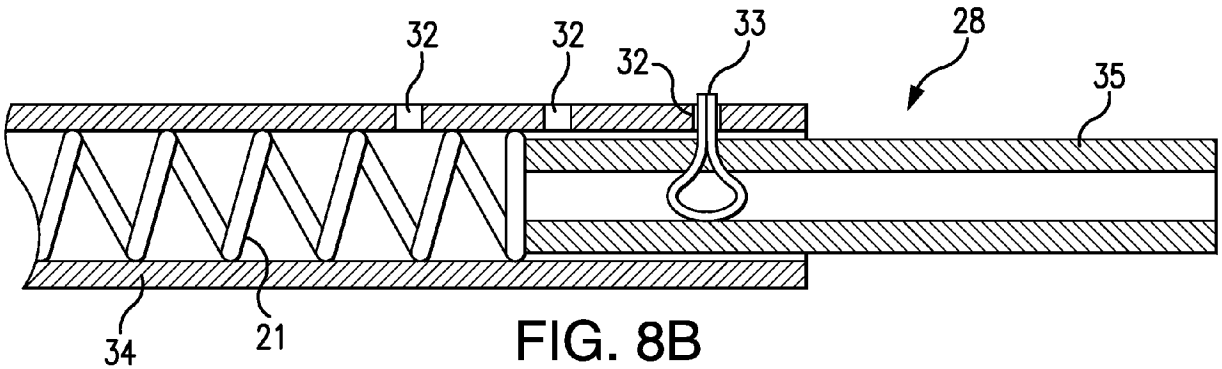
FIG. 8B is a cross section view of the telescoping tubular adjustable-length strut of FIG. 8A, taken along the line B-B'.

As shown in FIGS. 8A and 8B, the telescoping tubular strut 28 comprises an outer tube 34 having a coaxial inner tube 35, which is slidably extendable so as to adjust the overall length of the strut 28. The inner tube 35 can be locked in place at various extension lengths using a spring-button locking pin 33 with cooperating strut apertures 32.

When the cross-member 11 is in the horizontal position, as depicted in FIG. 4, the tubular strut 28 is extended to the appropriate length and the inner tube 35 is locked in place with the spring-button locking pin 33 engaging the appropriate aperture 32. In this position, the internal spring mechanism 21 within the strut 28 is in compression, i.e., tending to expand the length of the strut 28 and exerting a lifting torque on the forward arm 15 through the axial pin 14.

When the spring-button 33 is depressed and disengages the aperture 32, the spring mechanism 21 causes the strut 28 to expand, thereby lifting the forward arm 15 and causing it to rotate upward and backward toward the upper post 26 until it is in the elevated position, as depicted in FIG. 6. The cross-member 12 can then be locked in place in the elevated position by aligning the spring-button locking pin 33 with the corresponding aperture 32 in the outer tube 34 of the strut 28.

Figure 9:
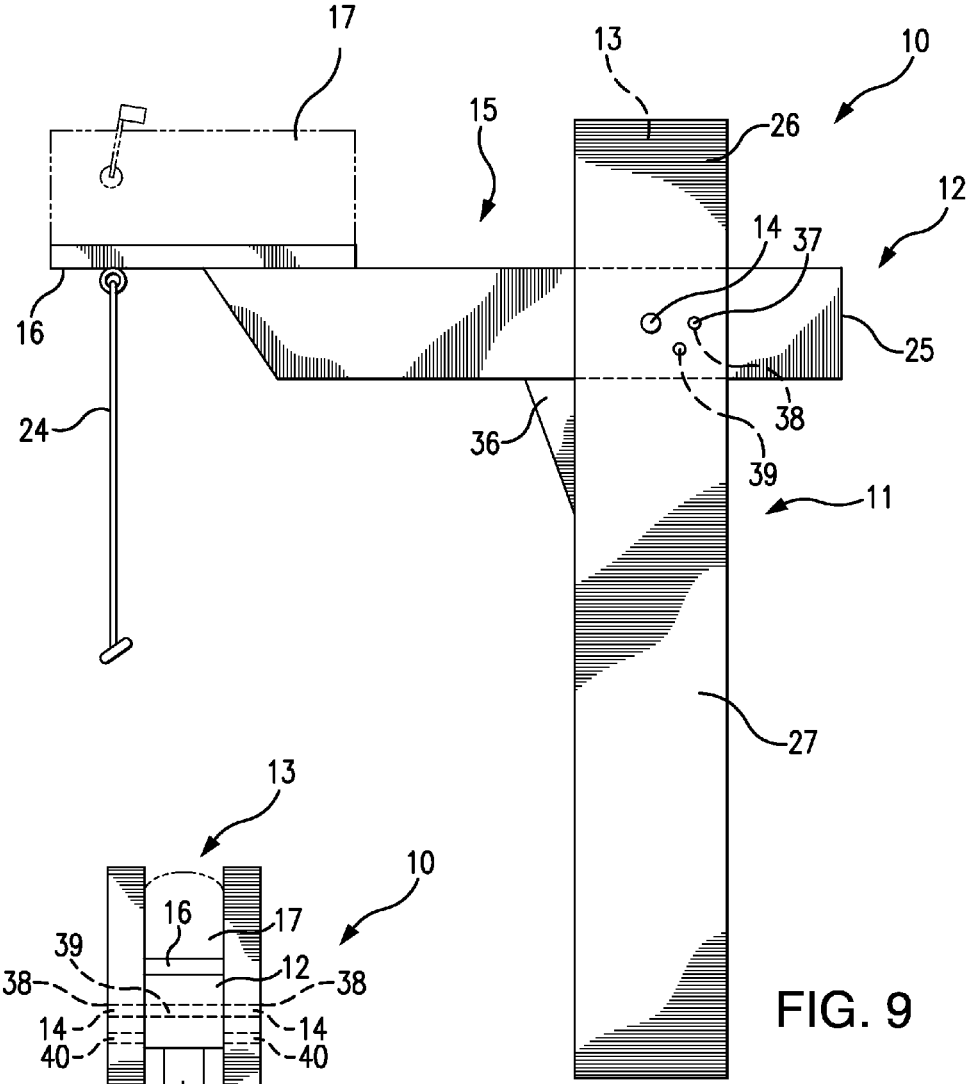
FIG. 9 is a side profile view of the third preferred embodiment of the present invention showing the cross-member in the horizontal position.
Figure 10:
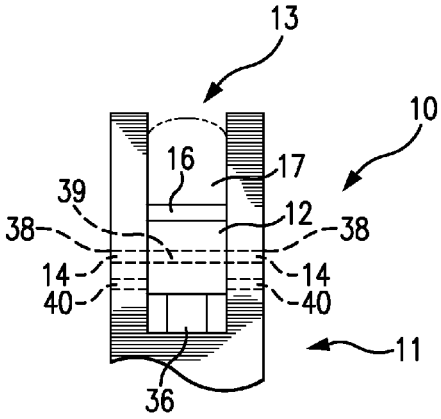
FIG. 10 is a partial rear profile view of the third preferred embodiment of the present invention showing the cross-member in the horizontal position.
Figure 11:
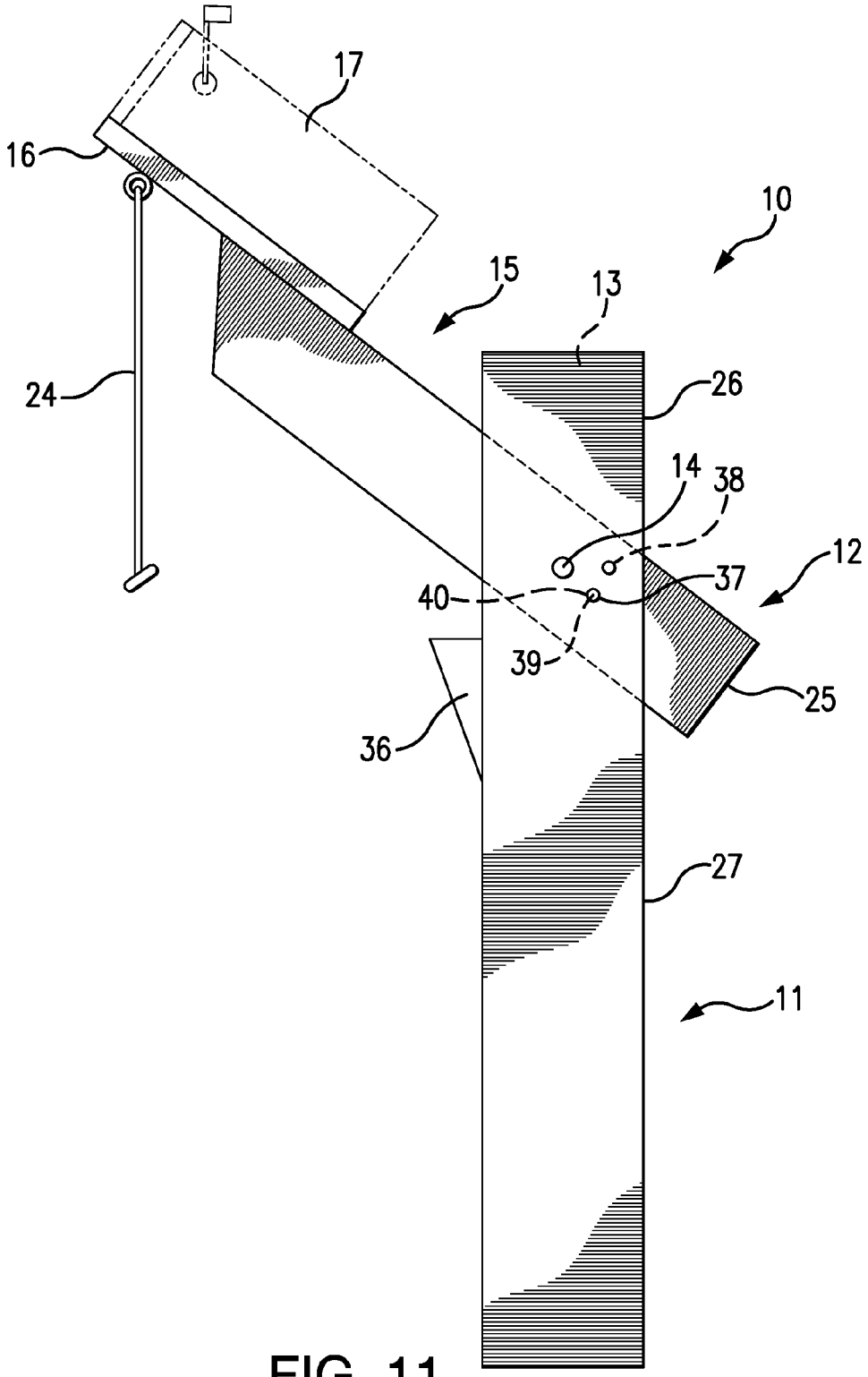
FIG. 11 is a side profile view of the third preferred embodiment of the present invention showing the cross-member in the elevated position.

Referring to FIGS. 9-11, the third preferred embodiment of the present invention 10 has a vertical support member 11, to which a cross-member 12 is rotatably attached by an axial pin 14. The cross-member 12 extends through a transverse first channel 13 in the upper post 26 of the support member 11, such that its forward arm 15 extends from one side of the support member 11, and its rear arm 25 extends from the other side. The forward arm 15 of the cross-member supports a mailbox platform 16, which can support a mailbox 17. The support member 11 comprises a branched upper post 26, through which the first channel 13 passes, and a lower post 27 below the first channel 13.

When the cross-member 12 is in the horizontal position, as shown in FIGS. 9 and 10, its forward arm 15 rests on a lateral support 36. The cross-member 12 is held in the horizontal position by a retaining pin 37, which is inserted through a transverse second channel 38 extending through the upper post 26 of the support member 11 and through a transverse third channel 39 through the cross-member 12. When the cross-member 12 is in the elevated position, as shown in FIG. 11, the insertion of the retaining pin 37 shifts to a transverse fourth channel 40 extending through the upper post 26 of the support member 11 and through the realigned transverse third channel 39 through the cross-member 12.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. An adjustable mailbox post, comprising:

a vertical support member rotatably attached at a transverse axis to a cross-member by one or more axial pins or rods;

wherein the support member comprises a branched upper post, through which a transverse first channel passes, and a lower post below the first channel;

wherein cross-member comprises a forward arm, which extends from a forward side of the support member, and a rear arm, which extends from a rear side of the support member;

wherein the forward arm supports a mailbox platform, to which a mailbox can be attached; and wherein the cross-member is supported in a horizontal position by a lateral support extending from the lower post of the support member and engaging a bottom surface of the forward arm; and wherein the cross-member is supported in an elevated position by a retaining pin inserted through a transverse channel extending through the upper post of the support member and through the cross-member.

* * * * *